United States Patent [19]

Jarvis

[11] 4,322,064

[45] Mar. 30, 1982

[54] OBJECT-SPACING TOOL AND METHOD THEREOF

[76] Inventor: Michael Jarvis, Rte. #1, Box 135, Old Calvert City Rd., Calvert City, Ky. 42029

[21] Appl. No.: 141,579

[22] Filed: Apr. 18, 1980

[51] Int. Cl.[3] ..... B25B 1/20

[52] U.S. Cl. ..... 269/43; 269/237; 269/901; 269/904; 269/910; 33/180R

[58] Field of Search ..... 269/43, 40, 45, 901, 269/904, 910, 237; 33/180 R, 174 G, 458, 478; 24/20 R, 20 EE, 20 TT, 21, 24, 221 R, 221 A; 83/435.2; 198/654, 692, 693

[56] References Cited

U.S. PATENT DOCUMENTS

| | | | |
|---|---|---|---|
| 556,790 | 3/1896 | Ward et al. | 33/458 |
| 734,014 | 7/1903 | Traut | 33/458 |
| 1,192,152 | 7/1916 | Atkinson | 24/20 EE |
| 1,334,822 | 3/1920 | Varble | 198/654 |
| 1,712,376 | 5/1929 | Burkhardt | 198/692 |
| 1,736,961 | 11/1929 | von Alvensleben | 24/20 R |
| 1,857,530 | 5/1932 | Dandridge et al. | 24/221 R |
| 2,567,586 | 9/1951 | Werder | 33/174 G |
| 2,686,959 | 8/1954 | Robinson | 29/285 |
| 2,744,334 | 5/1956 | Jondole | 33/180 |
| 3,201,874 | 8/1965 | Christy | 33/180 |
| 3,724,644 | 4/1973 | Reimers | 198/654 |

*Primary Examiner*—Robert C. Watson

*Attorney, Agent, or Firm*—Berman, Aisenberg & Platt

[57] ABSTRACT

A plurality of serially-disposed and pivotally-connected elements comprise the object-spacing tool of the present invention. The tool can be compactly folded to a size approximately the length of one element or expanded to a length approximately the total length of all the elements. Each element has two members projecting therefrom; typically, each projecting member is at or near an end of the element. Each projecting member is constructed to cooperate with a projecting member from an adjacent element for clamping an object therebetween. These cooperating pairs of projecting elements are spaced a fixed distance from each other, thereby spacing the objects clamped therebetween a predetermined distance from each other.

17 Claims, 7 Drawing Figures

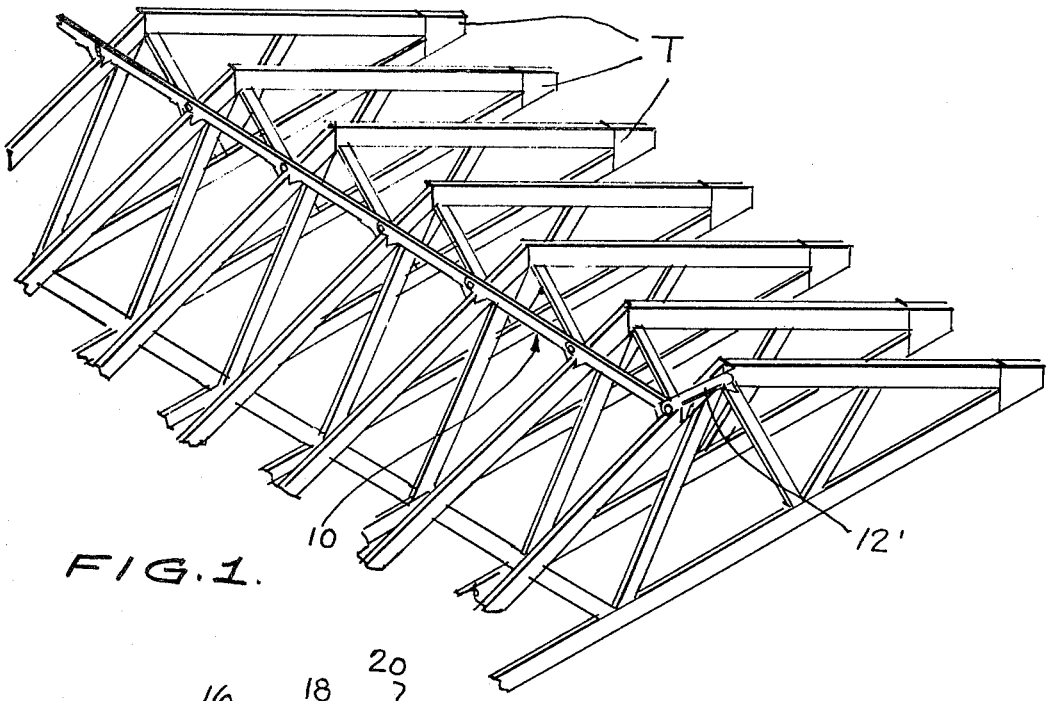
FIG. 1.
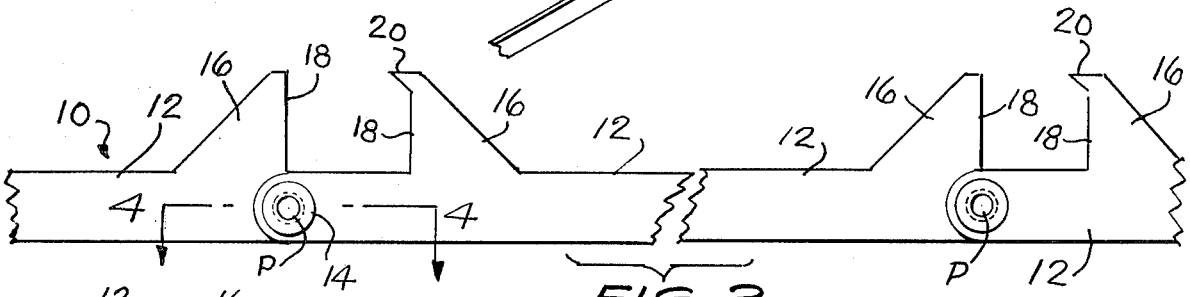
FIG. 2.
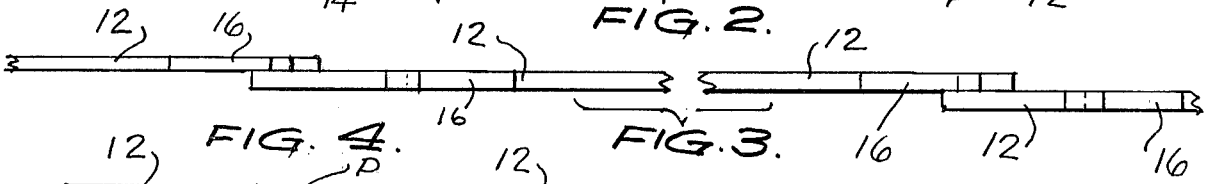
FIG. 4.
FIG. 3.
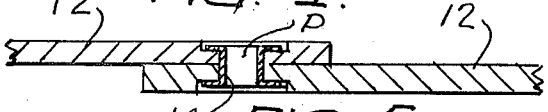
FIG. 5.
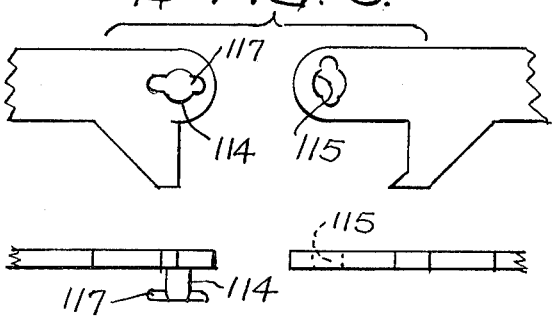
FIG. 6.
FIG. 7.
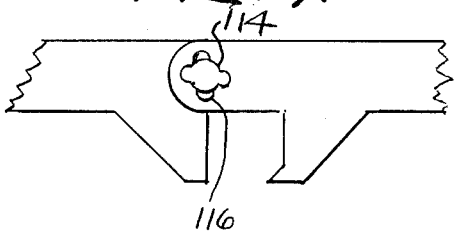

OBJECT-SPACING TOOL AND METHOD THEREOF

BACKGROUND OF THE INVENTION

The present invention relates to improvements in object-spacing tools, and more particularly to a spacing tool constructed of a plurality of serially-disposed and pivotally-connected elements.

Spacing tools have numerous applications in many fields, but are particularly useful in the construction field where a plurality of objects, such as studs or trusses, must be accurately spaced from each other. Nevertheless, many prior art spacing tools are troublesome to use, as they are quite cumbersome and prone to damage when subjected to rough handling. Moreover, some spacing tools can only be utilized to space a few objects before "breaking chain", while others include projecting members which interfere in the placement of large heavy objects. Typically, such objects have to be moved by crane or rig.

An example of a prior art spacing tool is that disclosed in U.S. Pat. No. 2,686,959 to W. C. Robinson.

It is an object of the present invention to provide a spacing tool which is both portable and rugged, yet capable of disposing a plurality of objects in a predetermined, spaced-apart relationship from each other.

These and other objects are met by the present invention, as will become more apparent from the description thereof which follows.

SUMMARY OF THE INVENTION

The object-spacing tool of the present invention includes a plurality of serially-disposed and pivotally-connected elements, with each element having two members projecting therefrom. Each projecting member is adapted to cooperate with another projecting member from an adjacent element for clamping an object therebetween. Each pair of cooperating projecting members is spaced a predetermined distance from an adjacent pair of similarly cooperating members. Hence, objects, clamped between cooperating pairs of projecting members, are spaced a fixed distance from each other.

In a preferred embodiment of the present invention, each of the projecting members is integral with an element on which it is carried. Moreover, each of the projecting members is disposed at or near an end of the element on which it is carried.

In the method of using the spacing tool of the present invention, each of a plurality of similar objects is clamped between a pair of cooperating projecting members, thereby spacing the objects a predetermined distance from each other.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a perspective view of the object-spacing tool of the present invention used in spacing a plurality of building trusses;

FIG. 2 is a partial, side elevational view of the present invention as shown in FIG. 1;

FIG. 3 is a top elevational view of the present invention as shown in FIG. 2;

FIG. 4 is a cross-sectional view of the present invention as seen along line 4—4 of FIG. 2;

FIGS. 5 and 6 are partial, side and top elevational views of another embodiment of the present invention, with the elements shown separated from each other; and FIG. 7 is a side elevational view of the present invention as shown in FIGS. 5 and 6, wherein the elements are linked together.

DETAILED DESCRIPTION OF THE INVENTION

Referring to the Figures, wherein like reference numerals represent identical corresponding parts throughout the several views, and more particularly to FIG. 1 thereof, the object-spacing tool of the present invention is indicated generally by reference numeral 10. As shown in FIG. 1, object-spacing tool 10 is used in fixing the spacing between a plurality of roof trusses, T. Of course, this is only one of the numerous applications of the present invention. However, in utilizing the spacing tool 10 to space apart trusses, it is preferable that the spacing tool 10 be applied as close as possible to the peak of the trusses.

Referring particularly to FIGS. 2 to 4, the object-spacing tool 10 includes a plurality of serially-disposed elements 12, which are elongated and planar in structure. Generally, elements 12 are constructed of a durable, rigid material, such as steel. Each element 12 is pivotally connected at its ends to adjacent elements 12 by a linking means 14, such as a rivet, as shown in FIGS. 2 and 4. Elements 12 are pivotable about an axis P. Preferably, elements 12 are pivotably connected in an off-set fashion to adjacent elements; hence, spacing tool 10 is foldable for storage and easy portability, yet expandable when needed for fixing the spacing between a plurality of objects.

Carried on, and integral with each of the elements 12 are two projecting members 16. Each projecting member 16 cooperates with a projecting member from an adjacent element 12 for clamping an object therebetween. Each member of a pair of cooperating-projecting members 16 is disposed at or near the axis P, about which adjacent elements are pivotable. Hence, by the pivotal displacement of two adjacent elements 12, one can readily clamp the projecting members 16 about an object to be disposed in spaced relationship to other similar objects.

Generally, each cooperating projecting member 16 is substantially in the form of a rightangled triangle; both cooperating projecting members have surfaces 18 which oppose each other. Preferably, opposing surfaces 18 are of a form or shape compatible with that of the object clamped therebetween, since it is surfaces 18 which make contact with the clamped object. In the embodiment of the present invention, as shown in FIG. 2, the opposed surfaces 18 are planar, although other conventional forms and shapes of the opposed surfaces are contemplated by the present invention. Moreover, at least one of each pair of cooperating projecting members 16 carries a tooth 20 along its opposing surface 18, which is capable of penetrating into the object to be spaced. Tooth 20 is beneficial in retaining the cooperating projecting members 16 clamped about an object; however, tooth 20 only has application when the objects to be spaced-apart are sufficiently soft to allow penetration by tooth 20, yet not susceptible to damage by the resulting penetration.

The distance between a pair of cooperating projecting members 16 depends, to a large extent, upon the size and shape of the objects to be spaced. Moreover, the location of a projecting member 16 on its respective element 12 can vary with different embodiments of the present invention. In the embodiment of spacing tool 10, as shown in FIGS. 1 to 4, the opposing surface 18 of one cooperating projecting member 16 is in a plane which intersects the pivotal axis P, while the opposing surface 18 of the other member 16 is in a plane spaced from the pivotal axis P. Nonetheless, any number of adaptations with respect to the location of members 16 is possible as, for example, where the plane of the opposing surfaces 18 are equidistantly disposed from the pivotal axis P.

Utilizing the present invention is now described with respect to FIG. 1, wherein a plurality of roof trusses T are to be spaced a predetermined distance apart from each other. Accordingly, each element 12 is of a predetermined length, thereby determining the center-to-center spacing between trusses T. Thus, once each pair of cooperating projecting members 16 is clamped upon a respective truss T, the plurality of trusses are spaced a predetermined and fixed distance from each other. The trusses T are secured in such spaced relationship to the building structure by conventional fastening means. Thereafter, each pair of cooperating projecting means 16 is caused to disengage a respective truss T by pivotally displacing adjacent elements 12.

In an application of the spacing tool 10, as shown in FIG. 1, it is further anticipated that the endmost element, designated 12', of a plurality of serially-disposed elements 12, can be off-set approximately 90° from the remaining elements 12 and clamped, by conventional means, to a truss T, thereby locking the trusses into the spaced relationship fixed by spacing tool 10.

In a typical construction of the present invention used in spacing trusses, the distance between adjacent pivotal axes P is approximately 24 inches (61 centimeters) while the distance between opposed surfaces 18 of each pair of cooperating projecting members 16 is approximately 1.5 inches (3.8 centimeters).

in a second embodiment of the present invention, as shown in FIGS. 5 to 7, the structure of the object-spacing tool 10 is the same as described above, except for the means by which the elements 12 are pivotally linked together. As heretofore discussed, elements 12 are permanently linked together in a pivotal fashion by means, such as rivets 14. However, in the second embodiment of the present invention, a button 114 is attached to one of two adjacent pivotally-connected elements 12, while the other element 12 has a keyway opening 115 therethrough.

Generally, the button 114 is substantially T-like in form, having a head designated by the numeral 117. Keyway opening 115 is slot-like in form, with head 117 of a configuration compatible in shape and size to slotted-keyway opening 115. However, head 117 and slotted-keyway opening 115 are oriented on their respective element 12, so that head 117 will pass through opening 115 only when the two elements are displaced at approximately 90° with respect to each other. Consequently, after head 117 has passed through opening 115, any further displacement between the two elements pivotally secures them together. It is most significant to the operation of the present invention that the two elements 12 are pivotally connected when they are in coaxial alignment with each other, as shown in FIG. 7; this, of course, would be the case when the present invention is used in fixing the spacing between objects.

It may be appreciated, therefore, that the present invention provides a simplistic, yet rugged device for spacing apart a plurality of similar objects. Moreover, the object-spacing tool of the present invention is portable and foldable for easy storage. Quite obviously, different sizes of the present invention may be utilized for different spacing requirements.

While this invention has been described with respect to specific embodiments, it is not limited thereto. The appended claims, therefore, are intended to be construed to encompass all forms and embodiments of the invention, within its true spirit and full scope, whether or not such forms and embodiments are expressly referred to herein.

What is claimed is:

1. A portable, rugged, object-spacing tool which is foldable for storage, expandable for use and disengageable for reuse, comprising:

a plurality of serially-disposed and pivtally-connected elements, each element having two members fixedly attached thereto and projecting therefrom, each member cooperating with a member projecting from an adjacent element for clamping an object therebetween, said cooperating members being spaced a predetermined distance from an adjacent pair of similarly-cooperating members, thus constituting clamping means for clamping plural objects between cooperating members, for spacing objects a fixed distance from each other, for holding the objects at the fixed distance until said objects are secured in place and for disengaging the objects thereafter.

2. An object-spacing tool according to claim 1 wherein at least one member of each pair of said cooperating members has a tooth means for engaging an object.

3. An object-spacing tool according to claim 1 wherein said elements are planar in structure.

4. An object-spacing tool according to claim 1 wherein each of said cooperating projecting members is positioned near an end of its respective element.

5. An object-spacing tool according to claim 1 wherein each member is integeral with the element from which it projects.

6. An object-spacing tool according to claim 1 further comprising linking means for pivotally connecting said elements to each other.

7. An object-spacing tool according to claim 6 wherein said linking means are rivets.

8. An object-spacing tool according to claim 6 wherein one of two adjacent pivotally-connected elements has a keyway opening therethrough, and the other of said elements has a button means attached thereto, said keyway opening being means to receive said button means in a manner which provides a connection between said adjacent elements.

9. An object-spacing tool according to claim 8 wherein said button means has a head which is slidable through said keyway opening upon said head being aligned with said keyway opening.

10. An object-spacing tool according to claim 9 wherein said keyway opening is generally slotted in shape, and said button means head is of a configuration compatible in shape and size to said slotted keyway opening.

11. An object-spacing tool according to claim 1 wherein cooperating members of adjacent pivotally-connected elements have opposing surfaces.

12. An object-spacing tool according to claim 11 wherein an opposing surface of one cooperating member is in a plane intersecting said adjacent, pivotally connected element at its pivotal axis.

13. An object-spacing tool according to claim 12 wherein an opposing surface of the other cooperating member is in a plane spaced from said pivotal axis.

14. A tool according to any one of claims 1 to 13 which is useful for spacing and securing in place studs or trusses and wherein:

(a) each pivotally-connected element has a pivot point at one or both ends thereof;

(b) each pivot point has an axis which is parallel to that of each other pivot point;

(c) each member is at or in close proximity to a pivot point;

(d) each pair of cooperating members, each member of which is on a different side of a pivot point and on a different element, defines therebetween a space within which an object can be secured when the pivotally-connected elements are disposed in a substantially straight line;

(e) each member of each pair of cooperating members constitutes means to impact an opposing surfaces of, to clamp down upon and to grasp an object therebetween to secure such object in place and in position; and (f) sequentially-disposed pairs of cooperating members constituting means to space a fixed distance from each other objects clamped between such cooperating members.

15. An object spacing tool according to claim 3 wherein each member lies in a plane coincident with that of the element from which it projects and remains in the plane when the tool is folded or expanded.

16. A method of spacing objects in fixed relation to each other using a spacing tool and in which the spacing tool is an object spacing tool according to claim 1, the method comprising clamping one of a plurality of similar objects between each of the adjacent pairs of cooperating members to space the objects a predetermined distance from each other.

17. A method of spacing objects in fixed relation to each other using a spacing tool and wherein the spacing tool is an object-spacing according to claim 1, the method comprising spacing studs or trusses with the object-spacing tool, securing the studs or trusses in place and thereafter disengaging the object-spacing tool.

* * * * *